US011800930B2

(12) United States Patent
Garcia et al.

(10) Patent No.: US 11,800,930 B2
(45) Date of Patent: Oct. 31, 2023

(54) PULL-OUT GUIDE

(71) Applicant: Paul Hettich GmbH & Co. KG, Kirchlengern (DE)

(72) Inventors: Oscar Garcia, San Sebastian (ES); Iker Lopetegi, Zarautz (ES)

(73) Assignee: PAUL HETTICH GMBH & CO. KG, Kirchlengern (DE)

( * ) Notice: Subject to any disclaimer, the term of this patent is extended or adjusted under 35 U.S.C. 154(b) by 171 days.

(21) Appl. No.: 17/432,529

(22) PCT Filed: Feb. 4, 2020

(86) PCT No.: PCT/EP2020/052698

§ 371 (c)(1),
(2) Date: Aug. 20, 2021

(87) PCT Pub. No.: WO2020/169332

PCT Pub. Date: Aug. 27, 2020

(65) Prior Publication Data

US 2022/0142365 A1 May 12, 2022

(30) Foreign Application Priority Data

Feb. 21, 2019 (DE) ..... 10 2019 104 421.9

(51) Int. Cl.
*A47B 88/487* (2017.01)
*A47B 88/473* (2017.01)

(52) U.S. Cl.
CPC ..... *A47B 88/487* (2017.01); *A47B 88/473* (2017.01); *A47B 2210/0018* (2013.01)

(58) Field of Classification Search
CPC ..... A47B 88/487; A47B 88/473; A47B 2210/0018
See application file for complete search history.

(56) References Cited

U.S. PATENT DOCUMENTS 5,671,988 A * 9/1997 O'Neill ..... A47B 88/493 312/334.44
8,752,917 B1 * 6/2014 Chang ..... A47B 88/487 312/334.47

(Continued)

FOREIGN PATENT DOCUMENTS

EP 2801292 A1 11/2014
EP 2802239 A1 11/2014
WO WO-2007017688 A1 * 2/2007 ..... A47B 88/493

OTHER PUBLICATIONS

European Office Action in PCT/EP2020/052698 dated Nov. 25, 2022 with English translation of relevant portions.

(Continued)

*Primary Examiner* — Hanh V Tran
(74) *Attorney, Agent, or Firm* — Collard & Roe, P.C.

(57) ABSTRACT

A pull-out guide has a guide rail, a running rail, which is mounted in a displaceable manner on the guide rail, and a braking device disposed between the guide rail and the running rail for braking the movement of the running rail relative to the guide rail. The braking device has at least one friction element, which is arranged between the running rail and the guide rail and can be displaced along a sliding surface by way of a contact pressure. The pull-out guide can thus be braked with continuous forces over a long period of time.

13 Claims, 12 Drawing Sheets

(56) References Cited

U.S. PATENT DOCUMENTS

| | | | | |
|---|---|---|---|---|
| 10,092,100 | B1 * | 10/2018 | Chen | A47B 88/40 |
| 2002/0175605 | A1 * | 11/2002 | Chen | A47B 88/487 312/334.44 |
| 2004/0119388 | A1 * | 6/2004 | Huang | A47B 88/487 312/334.44 |
| 2004/0239221 | A1 * | 12/2004 | Yang | A47B 88/40 312/334.46 |
| 2005/0017613 | A1 | 1/2005 | Cirocco et al. | |
| 2009/0283652 | A1 | 11/2009 | Chen et al. | |
| 2011/0123258 | A1 * | 5/2011 | Braun | A47B 88/40 403/109.3 |
| 2012/0169199 | A1 * | 7/2012 | Chen | A47B 88/57 312/334.44 |
| 2013/0058596 | A1 * | 3/2013 | Chen | F16C 29/048 384/7 |
| 2013/0077900 | A1 * | 3/2013 | Lowe | A47B 88/493 384/18 |
| 2014/0203697 | A1 * | 7/2014 | Wada | A47B 88/487 384/49 |
| 2016/0369844 | A1 * | 12/2016 | Ito | A47B 88/427 |
| 2017/0175811 | A1 * | 6/2017 | Zimmermann | A47B 88/497 |
| 2020/0077794 | A1 * | 3/2020 | Zimmermann | F16C 29/048 |
| 2021/0112981 | A1 * | 4/2021 | Cai | A47B 88/493 |
| 2021/0341015 | A1 * | 11/2021 | Zimmermann | F16C 29/12 |

OTHER PUBLICATIONS

International Search Report for PCT/EP2020/052698 dated Mar. 18, 2020 (with English translation).

* cited by examiner

PULL-OUT GUIDE

CROSS REFERENCE TO RELATED APPLICATIONS

This application is the National Stage of PCT/EP2020/052698 filed on Feb. 4, 2020, which claims priority under 35 U.S.C. § 119 of German Application No. 10 2019 104 421.9 filed on Feb. 21, 2019, the disclosures of which are incorporated by reference. The international application under PCT article 21(2) was not published in English.

BACKGROUND OF THE INVENTION

The present invention relates to a pull-out guide having a guide rail and a running rail which is movably mounted on the guide rail, wherein a braking device is provided between the guide rail and the running rail for braking the movement of the running rail relative to the guide rail.

EP 2 802 239 B1 discloses a pull-out guide in which a toothed rack and a rotation damper are provided between a guide rail and a running rail in order to brake a movement of the running rail relative to the guide rail. Particularly when used in the area of vehicle center consoles, this can reduce impact loads caused by a stop. This solution has proven itself, but the braking effect of the rotation damper is temperature-dependent due to the viscosity of the brake fluid.

SUMMARY OF THE INVENTION

It is therefore the object of the present invention to create a pull-out guide that enables a movement to be slowed down by simple means and has a compact structure.

This object is solved with a pull-out guide having the features of claim 1.

In the pull-out guide according to the invention, a braking device is provided between the guide rail and the running rail, which comprises a friction element that can be displaced along a sliding surface with a contact pressure. This produces a braking effect by friction when the friction element is displaced along the sliding surface. The friction element may optionally be fixed to the running rail or the guide rail, while the sliding surface is preferably integrally formed on the respective other rail. In a preferred design, the friction element pushes the guide rail and the running rail apart perpendicular to their longitudinal direction. As a result, the friction element can eliminate the play between the guide rail and the running rail that exists in pull-out guides by means of a pretension, so that vibrations do not cause rattling noises. In addition, the traverse movement is harmonized, which is perceived by the user as a high-quality guide.

The friction element preferably has a U- or V-shaped section on which at least one contact surface is formed. The contact surface is preferably formed on an outer region of a curved or bent section, which provides a certain elasticity.

The friction element is preferably held on a bent-over web formed integrally with the guide rail or the running rail. The web can be produced by punching out a U-shaped section and is preferably oriented at an angle of between 5° and 40°, in particular 7° to 20°, to the longitudinal direction of the guide rail or the running rail. For fixing to the bent-over web, the friction element can have, for example, two latching webs which grip around the bent-over web for fixing. The latching webs can have latching hooks at the ends and be designed integrally with the friction element. In addition, further projections or stop surfaces can be formed alongside the latching webs to ensure stable fixing of the friction element to the bent-over web. To prevent the friction element from being pulled off the bent-over web, the latter can have a widening end section. Alternatively, recesses, openings, embossments or steps can also be formed on the bent-over web, to which the friction element can be positively secured.

To adjust the frictional force during braking, the bent-over web can preferably be flexible. The metallic web can then be bent over more strongly to increase the braking force after a certain period of use.

In a further design, the friction element can be latched at at least one position on an embossing or profiling. In this case, the embossing can be designed as a projection projecting from the sliding surface or as a recess. In particular, the running rail can be latched relative to the guide rail at opposite end positions.

The friction element can be made entirely or predominantly of plastic. Optionally, the friction element can have a spring, for example a metallic spring, embedded in the plastic body of the friction element. This can compensate for fatigue effects on the plastic body.

The pull-out guide according to the invention preferably comprises only two rails, namely a running rail and a guide rail, which are formed with legs facing one another in a C-shaped cross section, wherein rolling elements are held in a movable manner on the legs.

The pull-out guide is preferably used on a vehicle console in which a cover is held in a sliding manner. Alternatively, the pull-out guide can also be used for a drawer element on a piece of furniture, household appliance or for other purposes. The drawer element can be designed as a drawer, tray base, keyboard drawer, container in a refrigerator, cutlery drawer in a dishwasher or basket.

BRIEF DESCRIPTION OF THE DRAWING FIGURES

The invention is explained in more detail below by means of several exemplary embodiments with reference to the accompanying drawings, wherein.

DETAILED DESCRIPTION OF THE INVENTION

Figure 1:
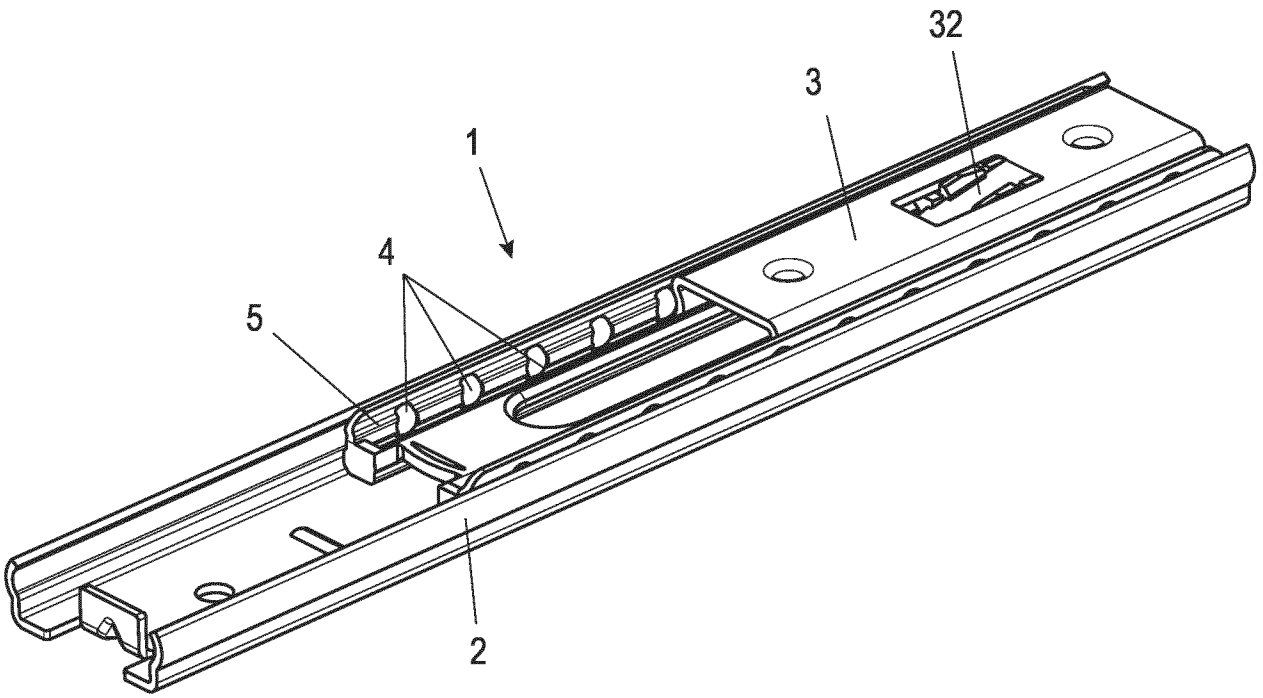
FIG. 1 shows a perspective view of a pull-out guide according to the invention.

A pull-out guide 1 comprises a guide rail 2 on which a running rail 3 is movably mounted. Spherical rolling elements 4 are provided for this purpose, which are arranged in a rolling element cage 5 between the guide rail 2 and the running rail 3.

Figure 2:
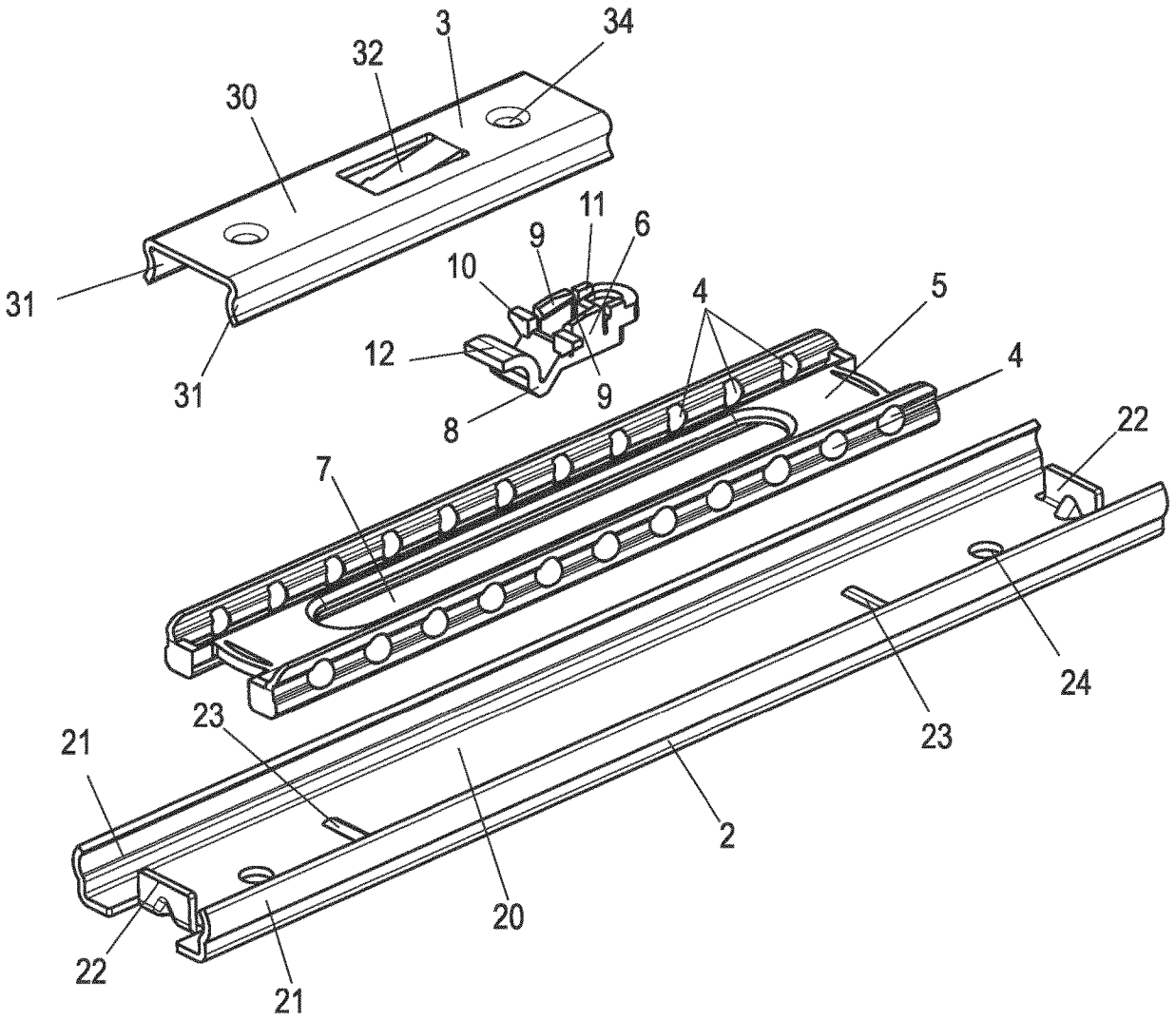
FIG. 2 shows an exploded perspective view of the pull-out guide of FIG. 1.

As can be seen from FIG. 2, guide rail 2 and running rail 3 have different lengths, wherein guide rail 2 can be designed more than twice as long as running rail 3. A braking device in the form of a friction element 6 is provided between guide rail 2 and running rail 3, which in the assembled position is arranged within an opening 7 in the rolling element cage 5.

The guide rail 2 is designed C-shaped in cross-section and comprises a base 20 on which a flat sliding surface for the friction element 6 is formed. Legs 21 protrude from the base 20 on opposite longitudinal sides, on which raceways for the rolling elements 4 are formed.

The running rail 3 is also C-shaped in cross-section and comprises a base 30, from which legs 31 protrude on the side facing the guide rail 2, on which raceways for the rolling elements 4 are formed. A bent-over web 32 is integrally formed on the base 30, to which the friction element 6 is fixed.

To limit the movement of the running rail 3, bent-over tabs 22 are provided at the end of the guide rail 2 in the region of the base 20, which limit a movement of the rolling element cage 5. Openings 24 are further provided on the guide rail 2 for mounting the guide rail 2 on another component, such as a vehicle console. Openings 34 are also provided on the guide rail 3 for mounting the guide rail 3 to a component, such as a cover.

The friction element 6 comprises, at a U- or V-shaped section, at least one contact surface 8 which is movable along a flat sliding surface on the base 20 of the guide rail 2. Two embossments 23 are formed on the base 20, which protrude from the sliding surface and on which the friction element 6 can be latched.

Figure 3A:
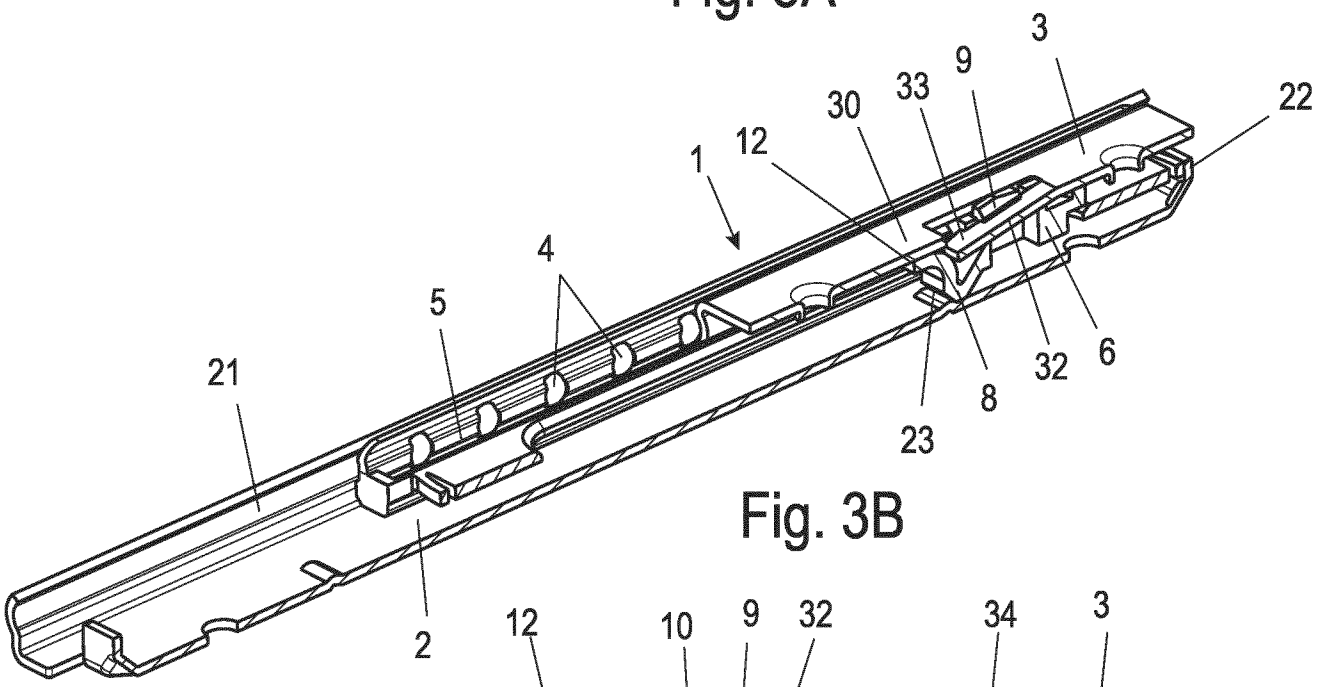
FIGS. 3A and 3B show two views of the pull-out guide of FIG. 1 in a first end position.
Figure 3B:
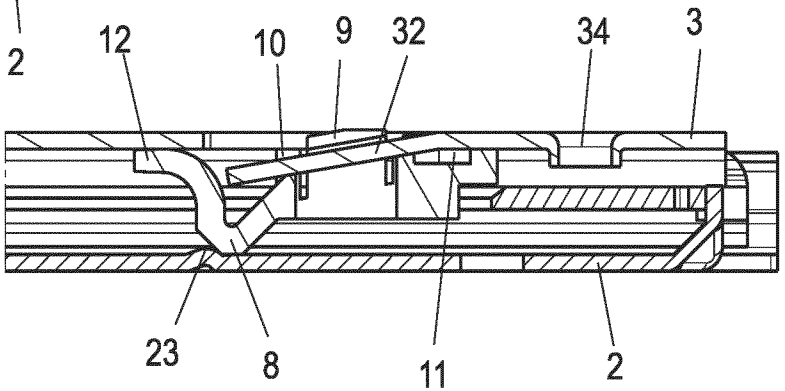

In FIGS. 3A and 3B, the pull-out guide 1 is shown in a first end position in which the contact surface 8 adjacent to the embossment 23 is latched. It can be seen that the friction element 6 is fixed to the bent-over web 32, which is oriented inclined to the longitudinal direction of the running rail 3, for example at an angle between 5° to 40°, in particular 7° to 20°. The bent-over web 32 is embraced by two latching webs 9 of the friction element 6, which are hook-shaped. The latching webs 9 do not protrude beyond the contour of the running rail 3, as can be seen in particular in the detailed view of FIG. 3B.

Adjacent to the latching webs 9, the friction element 6 comprises projections 10 which rest laterally against the bent-over web 32 and limit movement of the friction element 6 perpendicular to the longitudinal direction of the running rail 3. On the opposite side of the latching webs 9, stop elements 11 are provided which rest at least partially against a side of the running rail 3 facing the base 20 of the guide rail 2.

Figure 4A:
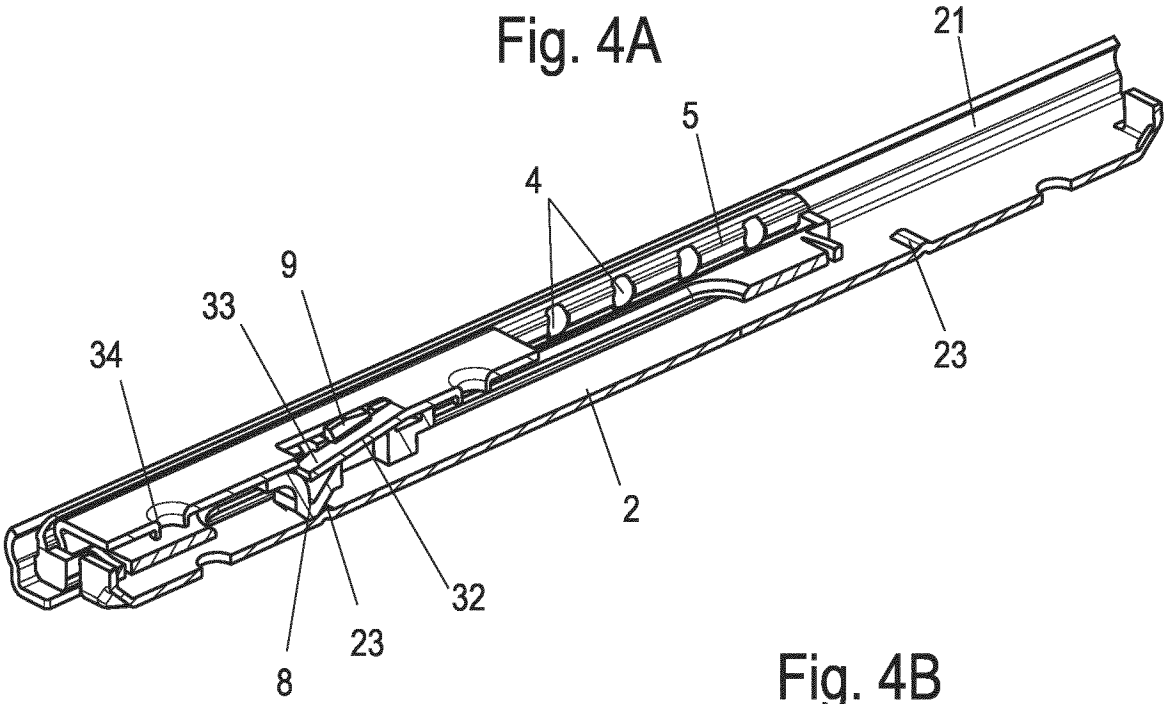
FIGS. 4A and 4B show two views of the pull-out guide of FIG. 1 in a second end position.
Figure 4B:
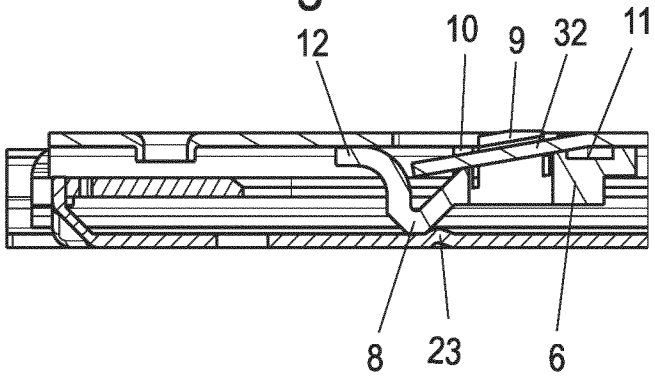

The friction element 6 pushes the running rail 3 away from the guide rail 2, wherein the contact surface 8 rests against the base 20 of the guide rail 2 and a support web 12 is supported against the base 30 of the running rail 3. If the running rail 3 is to be moved from the end position shown in FIGS. 3A and 36, the embossment 23 must first be driven over, which initially requires an increased amount of force. After the embossment 23 has been unlatched and passed over, the friction element 6 can then be moved along the sliding surface on the guide rail 2 until the contact surface 8 reaches the embossment 23 on the opposite side of the guide rail 2, as shown in FIGS. 4A and 4B. Then the contact surface 8 can be moved over the embossment 23 to latch the friction element 6 and thus the running rail 3 in the opposite end position.

Figure 5B:
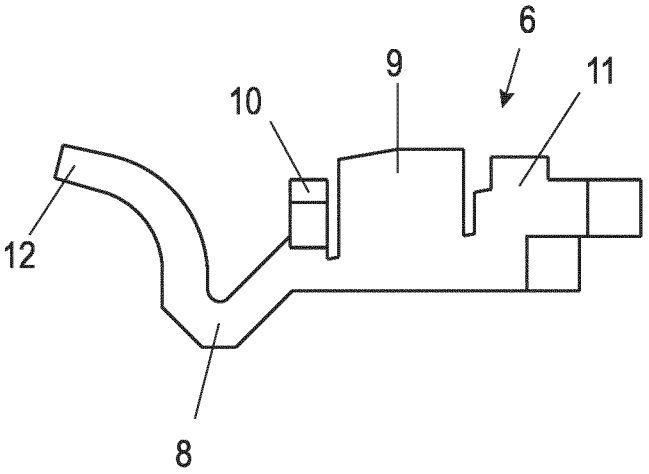
FIGS. 5A to 5C show several views of the friction element of the pull-out guide of FIG. 1.
Figure 5A:
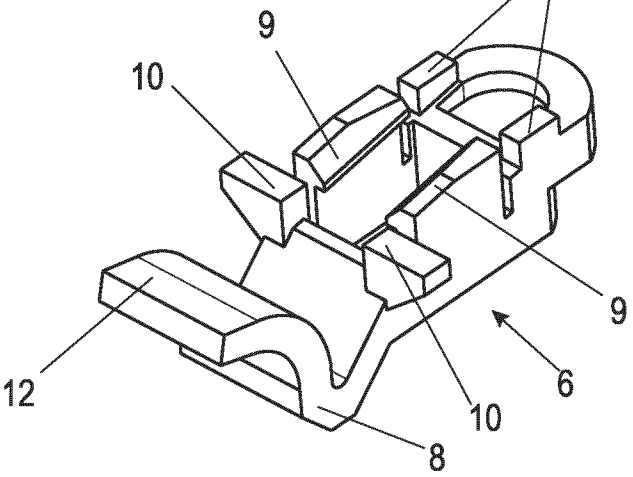
Figure 5C:
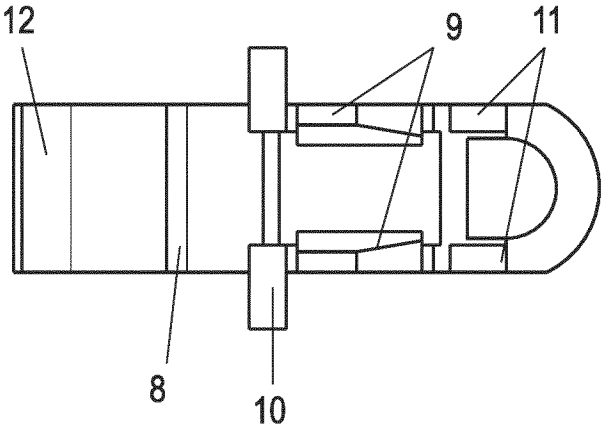

In FIGS. 5A to 5C, the friction element 6 is shown in detail. The friction element 6 is formed from an integral plastic body on which are integrally formed the latching webs 9, projections 10 and stop elements 11 that surround or embrace the bent-over web 32. Furthermore, the V-shaped section is integrally formed with the contact surface 8 and the support web 12. In the assembled position, the friction element 6 is formed so that it does not protrude from the running rail 3.

Figure 6B:
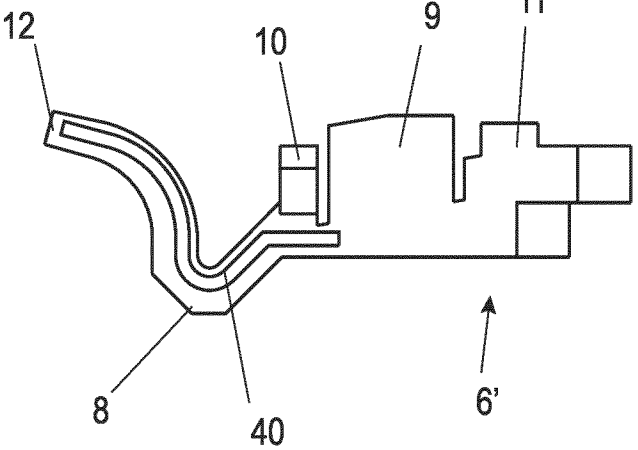
FIGS. 6A and 6B show two views of a modified friction element with a spring.
Figure 6A:
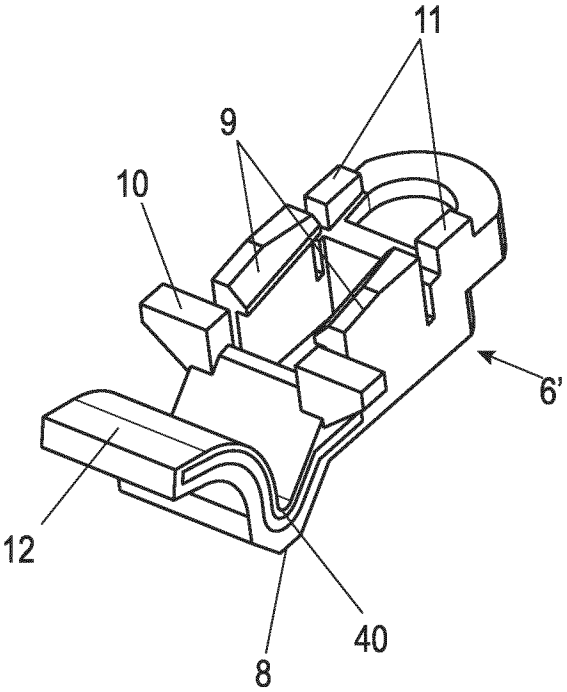

FIGS. 6A and 6B show a modified friction element 6', which has the same outer contour as the friction element 6 of FIG. 5. However, a metallic spring 40 is embedded in the area of the V-shaped section with the contact surface 8 and the support web 12, which reinforces the friction element 6' in this area. The spring 40 is designed in a strip-shaped manner and bent to match the contour of the V-shaped section of the friction element 6'. This allows fatigue phenomena of the plastic body to be compensated.

Figure 7B:
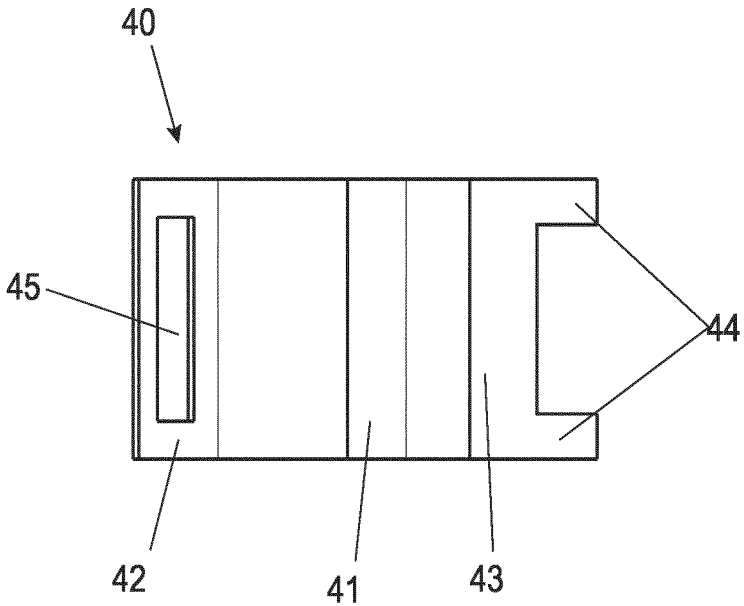
FIGS. 7A and 7B show two views of the spring of the friction element of FIG. 6.
Figure 7A:
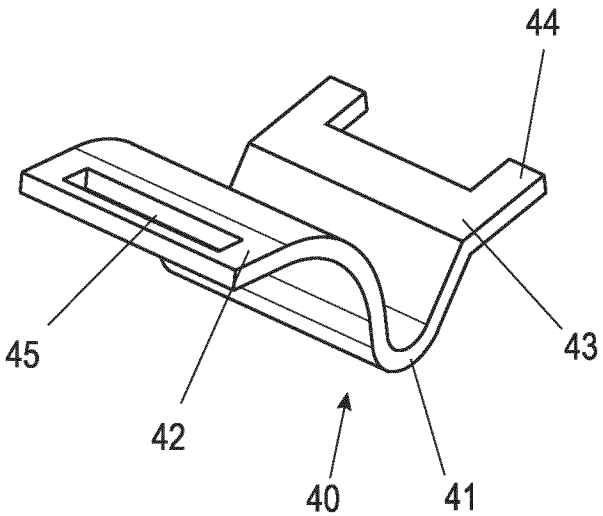

In FIGS. 7A and 7B, the metallic spring 40 is shown without the friction element 6'. The spring comprises an approximately U- or V-shaped section 41 from which extends a first leg 42, at which an opening 45 or recess is formed, into which plastic material can be introduced during manufacture of the friction element 6'. Projections 44 are formed on the other leg 43, extending to the latching webs 9 to reinforce the friction element 6' in this area.

Figure 8:
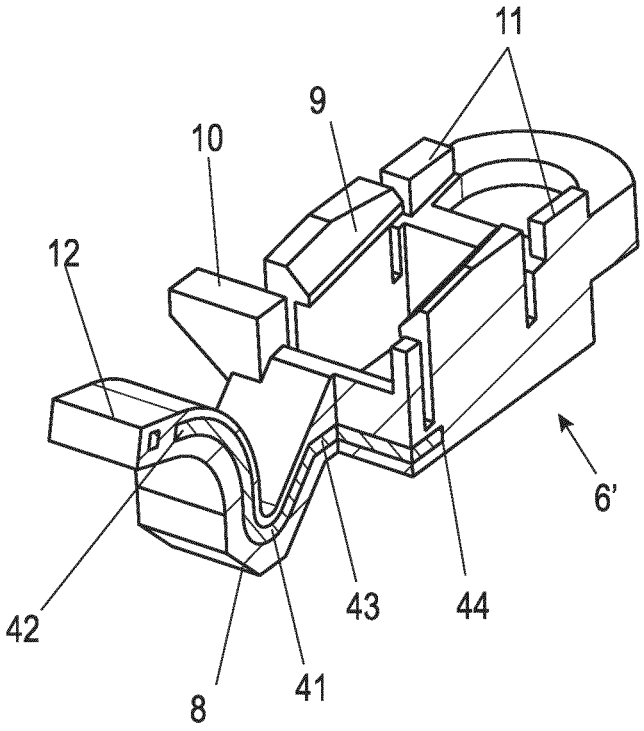
FIG. 8 shows a partial sectional view of the friction element of FIG. 6 with the spring.

In FIG. 8, the friction element 6' is shown in a partially sectional position with the embedded spring, which may be fully embedded in the friction element 6'. It can be seen that the spring 40 reinforces the friction element 6', particularly in the area of the contact surface 8, but does not limit movement of the latching webs 9 for mounting the friction element 6'.

Figure 9B:
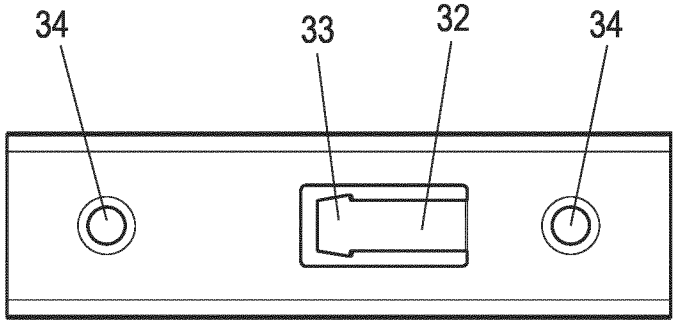
FIGS. 9A and 9B show two views of the running rail of the pull-out guide of FIG. 1.
Figure 9A:
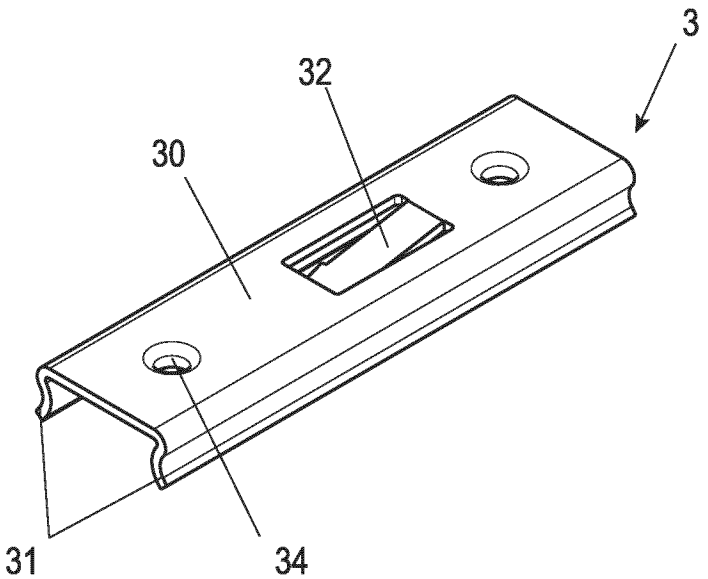

In FIGS. 9A and 9B, the shorter running rail 3 is shown in detail. The running rail 3 includes a substantially U-shaped recess on which the bent-over web 32 is integrally formed. A widening end section 33 is formed on the web 32, to which the friction element 6 or 6' can be fixed.

Figure 10A:
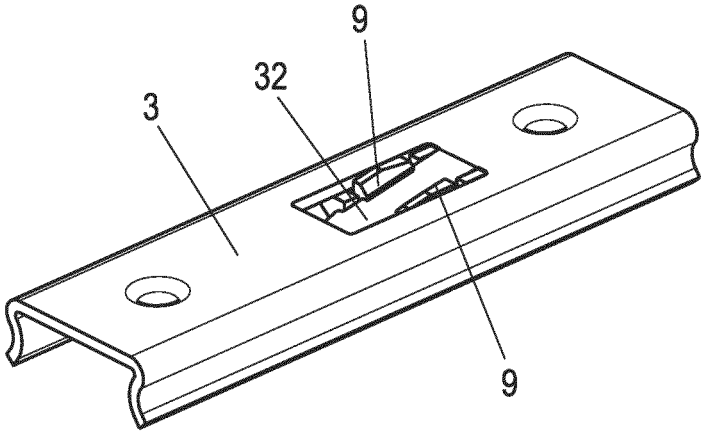
FIGS. 10A and 10B show two views of the running rail of FIG. 9 with the friction element mounted.
Figure 10B:
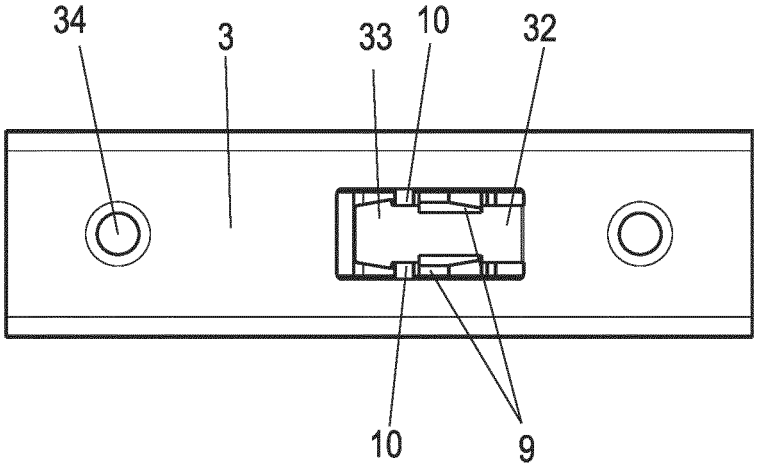

In FIGS. 10A and 10B, the running rail 3 is shown with the friction element 6 or 6' in the assembled position. It can be seen that the latching webs 9 of the friction element 6 or 6' partially overlap the bent-over web 32, and the projections 10 rest against the step between the widening end section 33 and a central section to secure the friction element 6 or 6' to the bent-over web 32.

Figure 11A:
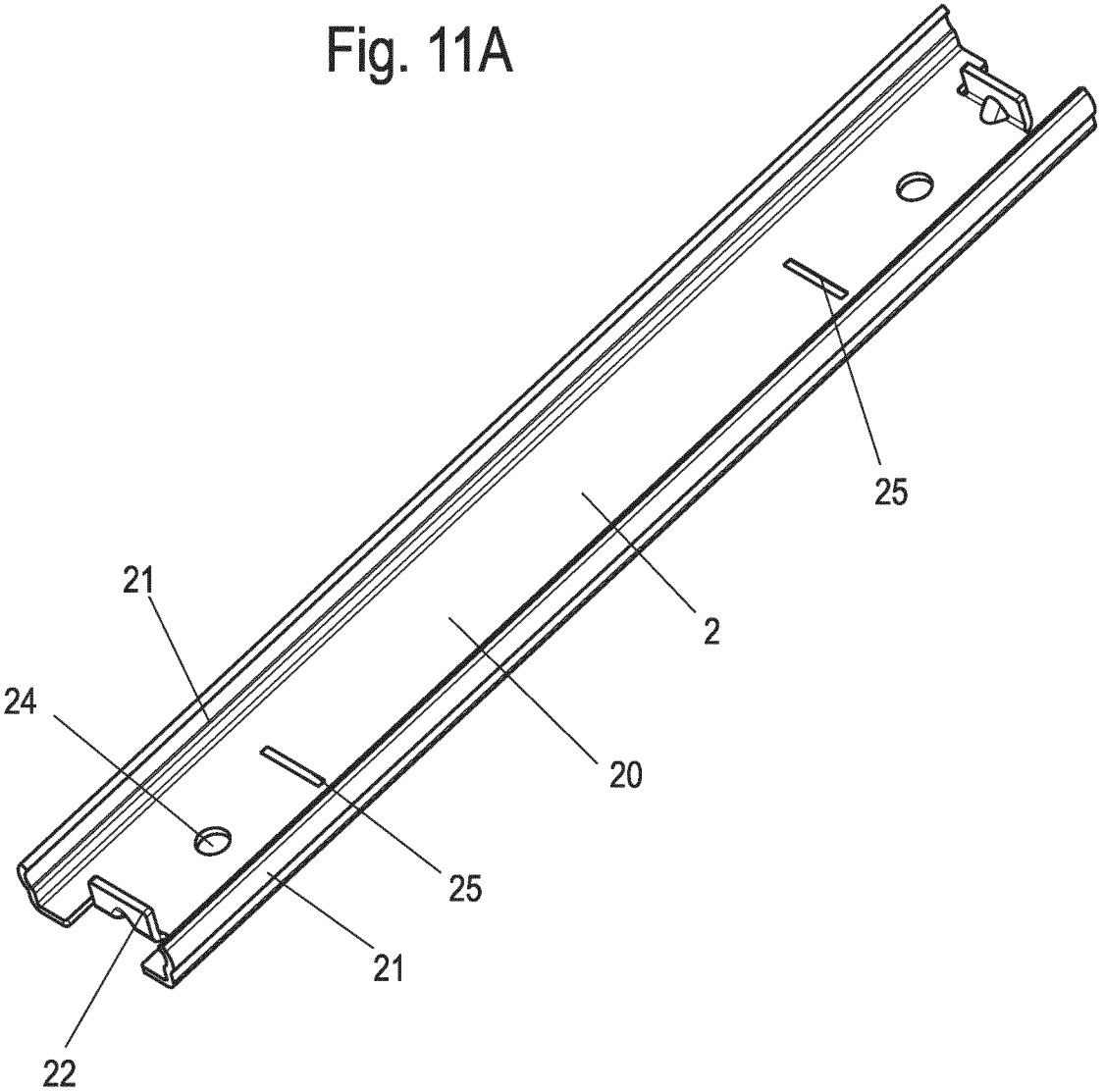
FIGS. 11A to 11C show several views of a modified guide rail for a pull-out guide of FIG. 1.
Figure 11C:
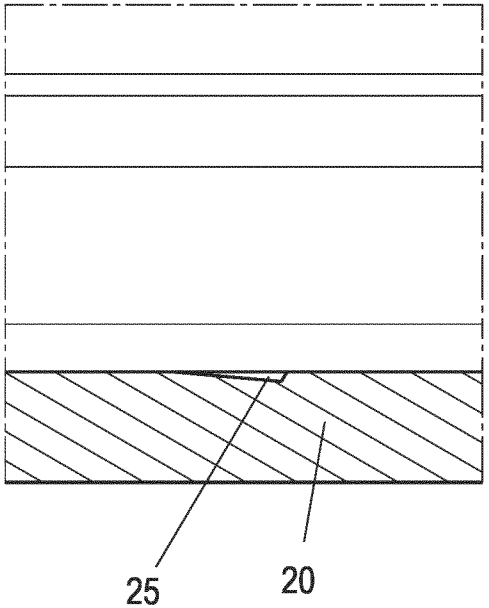
Figure 11B:
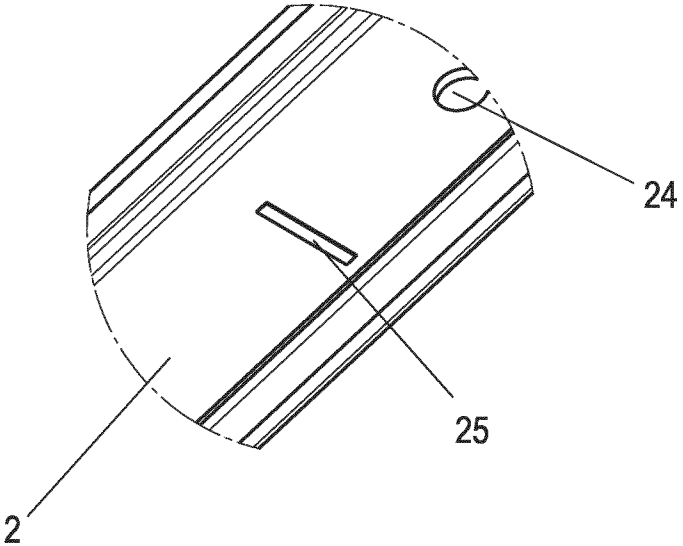

In FIGS. 11A to 11C a modified exemplary embodiment of a guide rail 2 is shown, which has a base 20 and projecting legs 21 as in the previous exemplary embodiment. Only in the area of the sliding surface on the base 20, recesses 25 are provided instead of the upwardly projecting embossments 23, as can be seen in particular in the detailed view of FIG. 11C. Such a recess 25 can also latch the friction element 6 or 6' in one of the two end positions when the contact surface 8 is received in the recess 25. The introduction of a recess 25 instead of a projection reduces the material stress during latching and unlatching of the friction element 6 or 6'.

In the illustrated exemplary embodiment, the friction element 6 or 6' is provided on the shorter running rail 3, and the sliding surface is formed on the longer guide rail 2. Of course, it is also possible to provide the friction element 6 or 6' on the guide rail 2 and to form a sliding surface on the running rail 3.

Moreover, only a single friction element 6 or 6' is arranged between the guide rail 2 and the running rail 3. It is also possible to provide several such friction elements 6 or 6'.

LIST OF REFERENCE NUMERALS

1 Pull-out guide
2 Guide rail
3 Running rail
4 Rolling elements
5 Rolling element cage
6, 6' Friction element
7 Opening
8 Contact surface
9 Latching web
10 Projection
11 Stop element
12 Support web
20 Base
21 Leg
22 Tab
23 Embossment
24 Opening
25 Recess
30 Base
31 Leg
32 Web
33 End section
34 Opening
40 Spring
41 Section
42 Leg
43 Leg
44 Projection
45 Opening

What is claimed is:

1. A pull-out guide (1) comprising: a guide rail (2), a running rail (3) displaceably mounted on the guide rail (2), and a braking device disposed between the guide rail (2) and the running rail (3) for braking a movement of the running rail (3) relative to the guide rail (2), wherein the braking device comprises at least one friction element (6) arranged between the running rail (3) and the guide rail (2), which friction element (6) is displaceable along a sliding surface with a contact pressure, wherein the friction element (6) is configured to be fixed to the running rail (3) or the guide rail (2), while the sliding surface is integrally formed in one piece with the respective other rail and the friction element (6) is configured to be latched at at least one position on an embossment (23), profiling or recess (25) on the guide rail (2) or the running rail (3), wherein the running rail (3) is configured to be latched relative to the guide rail (2) at opposite end positions, and wherein the friction element (6) is held on a bent-over web (32) formed integrally in one piece with the guide rail (2) or the running rail (3).

2. The pull-out guide according to claim 1, wherein the friction element (6) presses the guide rail (2) and the running rail (3) apart perpendicular to a longitudinal direction of the guide rail and the running rail.

3. The pull-out guide according to claim 1, wherein the friction element (6) has at least one contact surface (8) on a U- or V-shaped section which rests against the sliding surface.

4. The pull-out guide according to claim 1, wherein the bent-over web (32) is oriented at an angle between 5° and 40° with respect to the longitudinal direction of the guide rail (2) and the running rail (3).

5. The pull-out guide according to claim 1, wherein the friction element (6) has two latching webs (9) which engage around the bent-over web (32) for fixing the friction element on the bent-over web.

6. The pull-out guide according to claim 1, wherein the bent-over web (32) has a widening end section (33).

7. The pull-out guide according to claim 1, wherein the bent-over web (32) can be bent to adjust a braking force.

8. The pull-out guide according to claim 1, wherein the friction element (6) has a spring (40).

9. The pull-out guide according to claim 1, wherein the friction element (6) has a plastic body.

10. The pull-out guide according to claim 9, wherein a metallic spring (40) is embedded in the plastic body.

11. The pull-out guide according to claim 1, wherein the running rail (3) and the guide rail (2) are designed to be C-shaped in cross-section with mutually facing limbs (21, 31) on which rolling elements (4) are held in a displaceable manner.

12. A vehicle console having a cover which is held in a displaceable manner via at least one pull-out guide (1) according to claim 1.

13. A furniture item or household appliance having at least one drawer element which is displaceably held in a carcass via at least one pull-out guide (1) according to claim 1.

* * * * *